US007914178B2

(12) United States Patent
Xiang et al.

(10) Patent No.: US 7,914,178 B2
(45) Date of Patent: Mar. 29, 2011

(54) LED LAMP

(75) Inventors: Qian Xiang, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 170 days.

(21) Appl. No.: 12/432,740

(22) Filed: Apr. 29, 2009

(65) Prior Publication Data

US 2010/0208461 A1 Aug. 19, 2010

(30) Foreign Application Priority Data

Feb. 18, 2009 (CN) ..... 2009 1 0300472

(51) Int. Cl.
*F21V 29/00* (2006.01)

(52) U.S. Cl. ... 362/294; 362/218; 362/241; 362/249.02; 362/249.06; 362/373

(58) Field of Classification Search ..... 362/218, 362/241, 249.02, 249.06, 294, 373
See application file for complete search history.

(56) References Cited

U.S. PATENT DOCUMENTS

| | | | | |
|---|---|---|---|---|
| 7,661,854 | B1 * | 2/2010 | Yang et al. | 362/373 |
| 7,682,050 | B2 * | 3/2010 | Xiang et al. | 362/294 |
| 2009/0103308 | A1 * | 4/2009 | Xu et al. | 362/294 |

* cited by examiner

*Primary Examiner* — Stephen F Husar
(74) *Attorney, Agent, or Firm* — Frank R. Niranjan

(57) ABSTRACT

A hanging LED lamp includes a base, a heat sink attached to a bottom of the base, a plurality of heat conducting plates coupled to a periphery of the heat sink and connecting with the base and the heat sink, a plurality of LED modules mounted on the heat conducting plates, a cover engaging the base and covering the heat sink, the heat conducting plates and the LED modules therein, and a fixing member connecting a top of the base to fix the LED lamp in a desired position. A plurality of heat pipes are embedded in the heat conducting plates with first ends connecting with the heat sink and second ends connecting with the base.

17 Claims, 4 Drawing Sheets

LED LAMP

BACKGROUND

1. Technical Field

The present disclosure relates to light emitting diode (LED) lamps and, more particularly, to an improved LED lamp having a novel structure for lighting.

2. Description of Related Art

LED lamp, a solid-state lighting, utilizes LEDs as a source of illumination, providing advantages such as resistance to shock and nearly limitless lifetime under specific conditions. Thus, LED lamps present a cost-effective yet high quality replacement for incandescent and fluorescent lamps.

Known implementations of LED modules in an LED lamp make use of a plurality of individual LEDs to generate sufficient light. The large number of LEDs, however, increases price and power consumption of the module. Considerable heat is also generated, which, if not adequately addressed at additional expense, impacts LED lamp reliability.

Further, since the LEDs are generally arranged on a printed circuit board having a planar surface, illumination is distributed at a wide variety of spatial angles with marked differences in intensity and brightness, making it unsuitable for environments requiring even and broad illumination.

What is needed, therefore, is an LED lamp which can overcome the limitations described.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
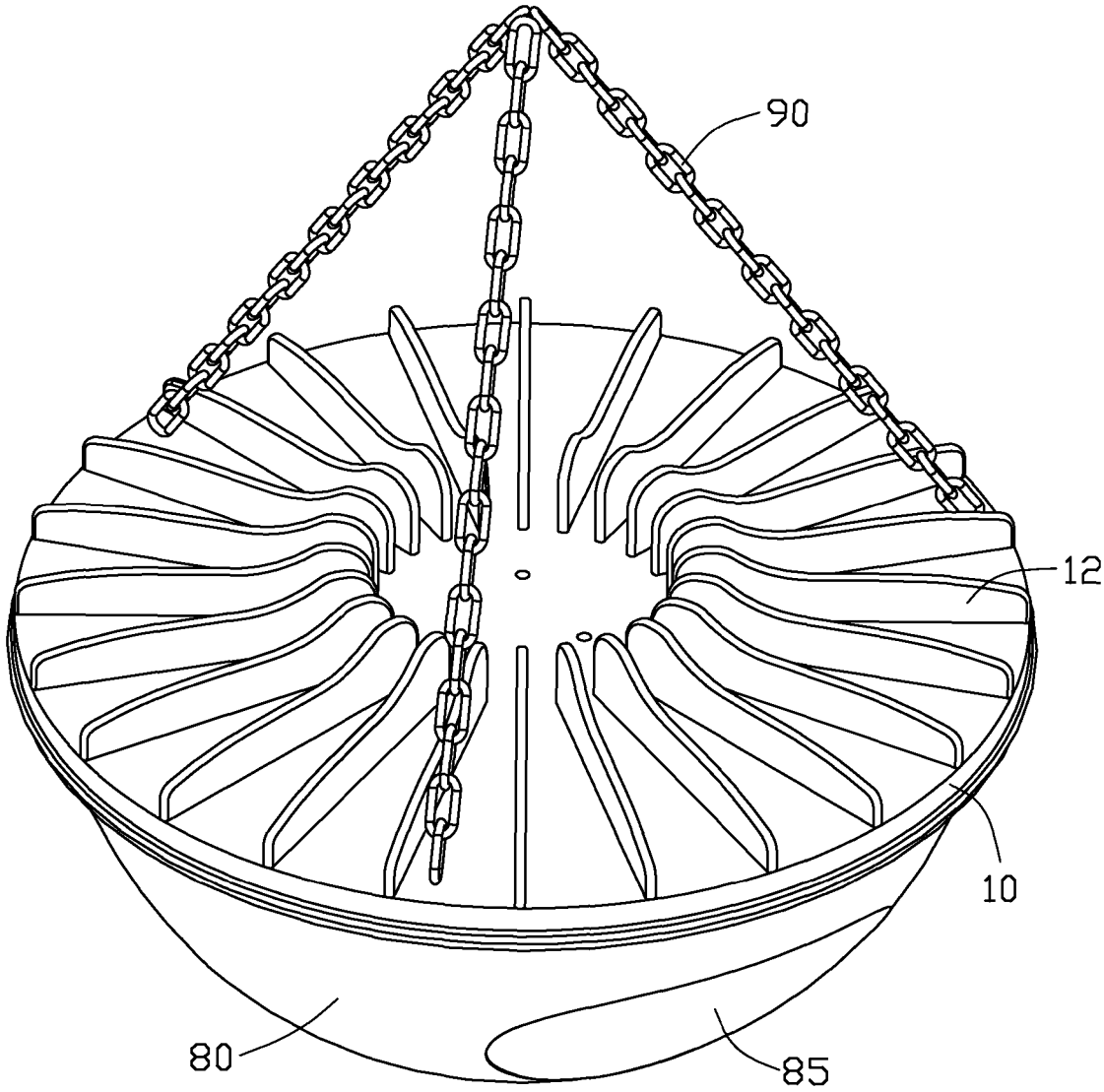
FIG. 1 is an isometric, assembled view of an LED lamp in accordance with an embodiment of the present disclosure.
Figure 2:
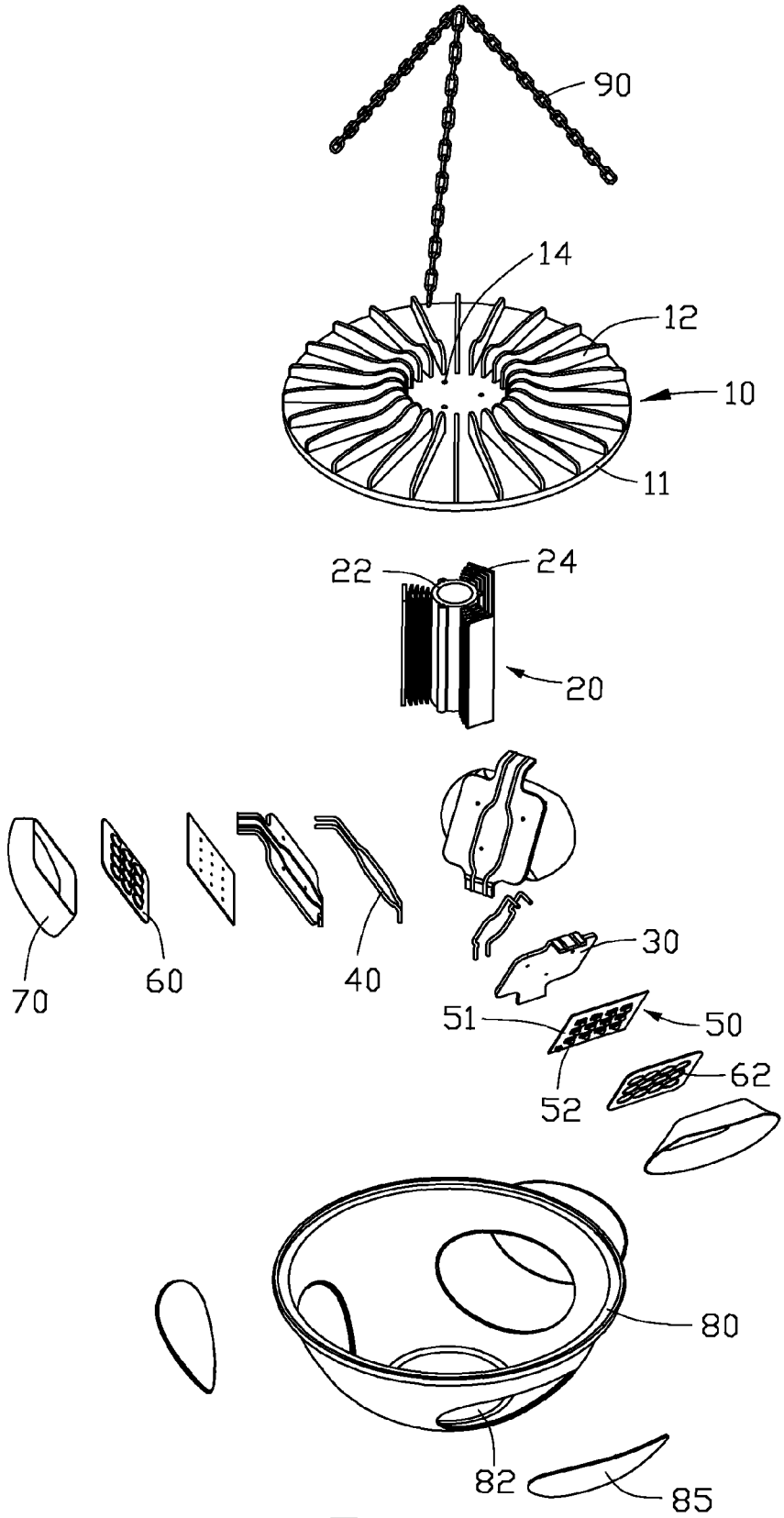
FIG. 2 is an exploded view of the LED lamp in FIG. 1.

Referring to FIGS. 1-2, an LED lamp, particularly an hang LED lamp, in accordance with an embodiment comprises a heat dissipation device (not labeled) and three LED modules 50 coupled to the heat dissipation device. The heat dissipation device comprises a base 10, a heat sink 20 attached to a bottom of the base 10, three heat conducting plates 30 surrounding the heat sink 20 and connecting with the base 10 and the heat sink 20, and two heat pipes 40 attached to a top surface of each heat conducting plate 30 and connecting with the base 10 and the heat sink 20. The LED modules 50 are mounted on bottom surfaces of the heat conducting plates 30, respectively. A first reflector 60 and a second reflector 70 are mounted on each LED module 50 to reflect light generated therefrom. The LED lamp further comprises a cover 80 and three envelopes 85 adhered to the cover 80. The cover 80 engages the base 10 and covers the heat conducting plates 30, the heat pipes 40, the LED modules 50 and the first and second reflectors 60, 70 therein. A fixing member 90 is installed on the base 10, for connecting with a hook attached to a bottom end of a mounting post (not shown) to thereby position the LED lamp at a desired position, for example, a position beneath a ceiling.

The base 10 comprises a round chassis 11 and a plurality of fins 12 extending upwardly from a top face of the round chassis 11. Three holes 14 are defined symmetrically in a center of the chassis 11. The fins 12 extend radially on the chassis 11 and surrounds the holes 14.

Figure 3:
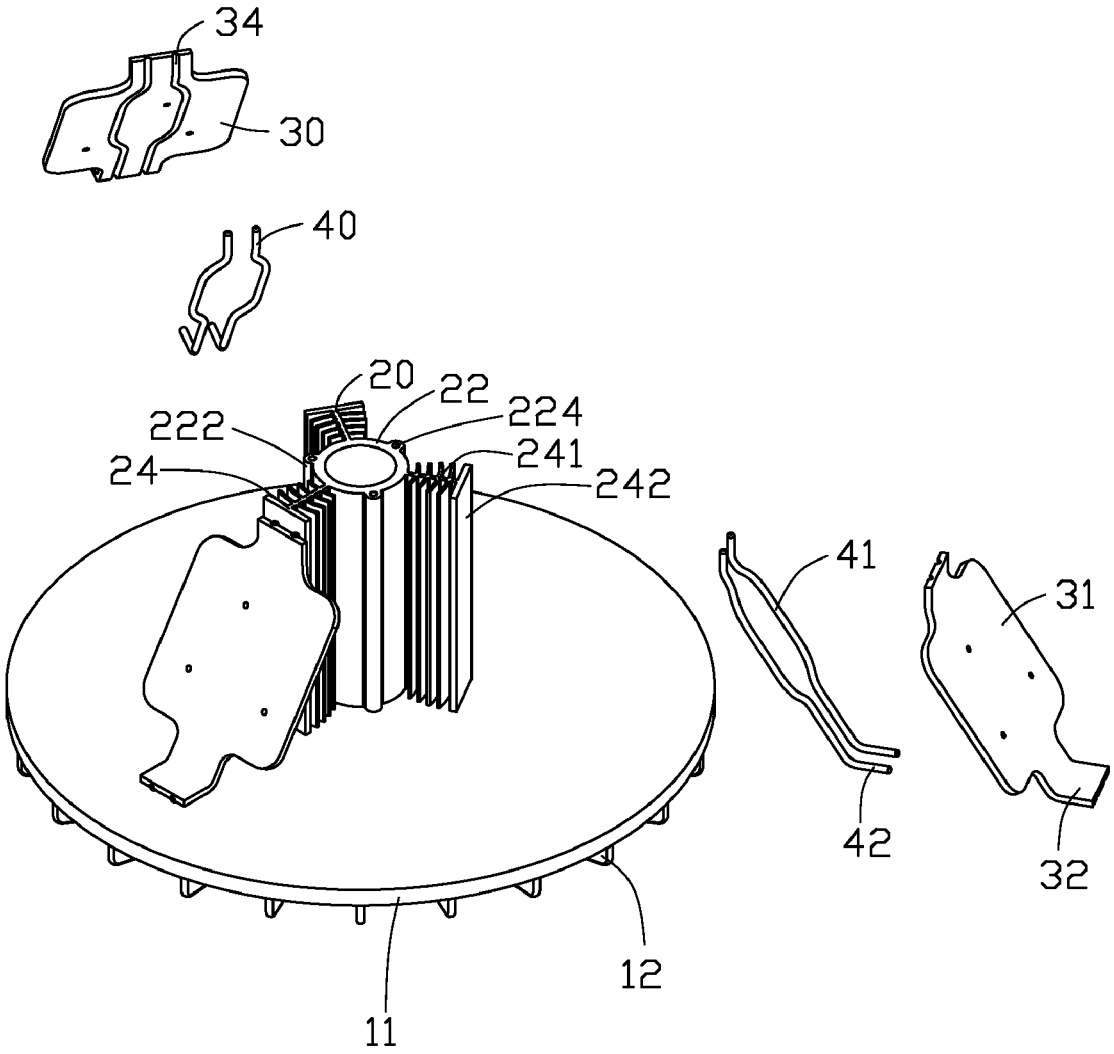
FIG. 3 is a partly assembled view of a heat dissipation device of the LED lamp in FIG. 2.
Figure 4:
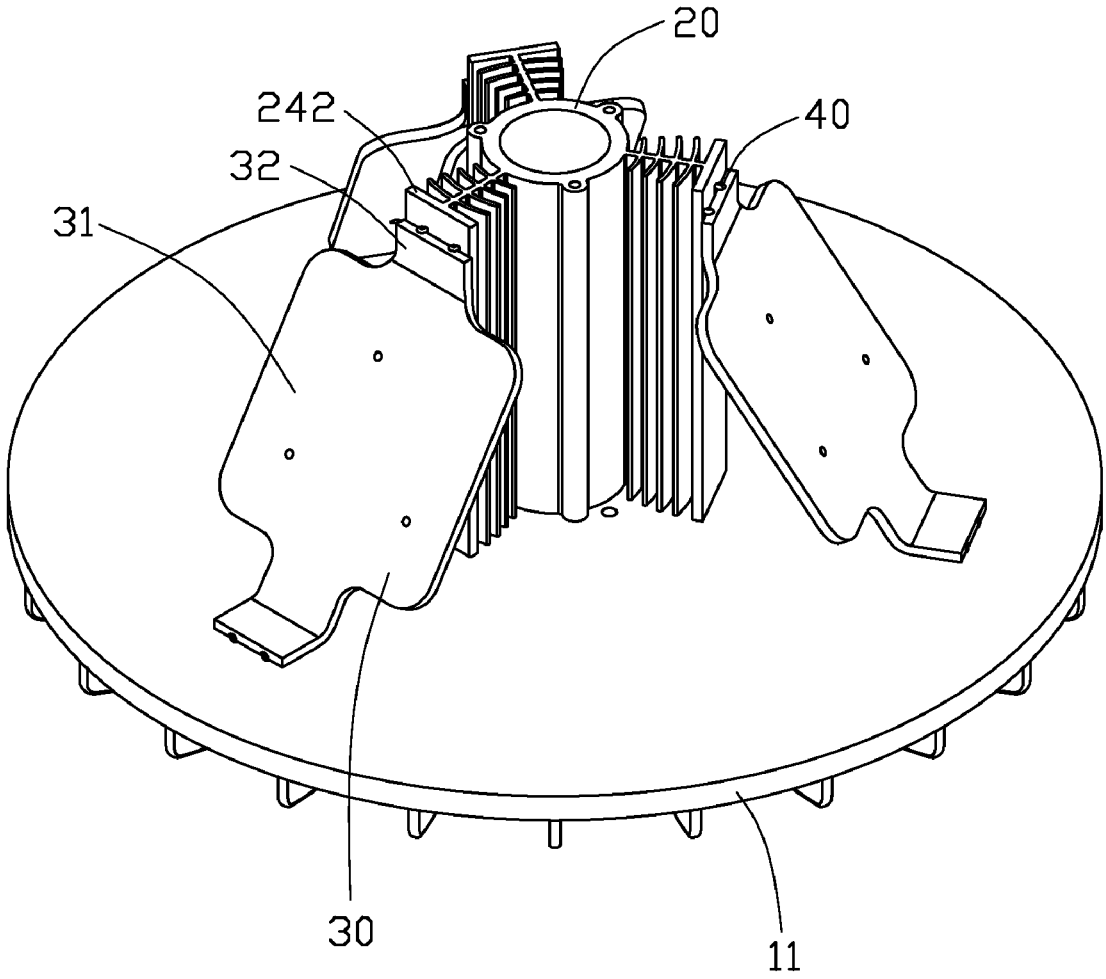
FIG. 4 is an isometric, assembled view of the heat dissipation device of the LED lamp in FIG. 3.

Referring to FIGS. 3 and 4, the heat sink 20 comprises a tubular heat conducting body 22 and three symmetrical heat conducting branches 24 extending from an outer surface of the heat conducting body 22. A longitudinal protrusion 222 is formed on the outer surface of the heat conducting body 22 and located between every two heat conducting branches 24. Corresponding to the holes 14 of the base 10, securing holes 224 are defined in top ends of the protrusions 222 for fasteners (not shown) such as screws extending through the holes 14 of the base 10 and screwing therein to securely connect the heat sink 20 and the base 10 together. Understandably, the heat conducting body 22 in the present embodiment, which is a round tube and defines a through hole in a center thereof, could be solid in alternative embodiments, and a cross-section thereof could be a parallelogram, rhombus or any other symmetrical geometrical figures. Each heat conducting branch 24 comprises a first branch 241 extending from the outer surface of the heat conducting body 22 and a plurality of second branches 242 crossing with the first branch 241. The second branches 242 are apart from each other. An outermost second branch 242 which is far away from the heat conducting body 22 has a shape of a rectangular, flat panel, and other second branches 242 each have an arced shape which is homocentric with the heat conducting body 22. The first and second branches 241, 242 function as fins to increase a heat dissipation area of the heat sink 20.

The heat conducting plates 30 are made of metallic material with good heat conductivity such as aluminum or copper and each comprise a rectangular heat absorbing portion 31 and two engaging portions 32 bending from top and bottom ends thereof. The engaging portion 32 is narrow than the heat absorbing portion 31. The engaging portion 32 at the bottom end of the heat absorbing portion 31 contacts the outer second branch 242 of the heat conducting branch 24. The engaging portion 32 at the top end of the heat absorbing portion 31 contacts a bottom surface of the chassis 11. The top surface of the heat conducting plate 30 which faces the heat sink 20 defines two curved grooves 34, receiving the heat pipes 40 therein.

The heat pipes 40 each comprise a heat absorbing section 41 and two heat dissipating sections 42 bending from two ends of the heat absorbing section 41. The heat absorbing section 41 corresponds to the heat absorbing portion 31 of the heat conducting plate 30. The heat dissipating section 42 corresponds to the engaging portion 32 of the heat conducting plate 30. It is understood that a number of the heat pipes 40 embedded in each heat conducting plate 30 could be varied in alternative embodiments.

The LED modules 50 each comprise a printed circuit board 51 and a plurality of LEDs 52 mounted on the board 51 in matrix. The LED modules 50 are mounted under the heat absorbing portions 31 of the heat conducting plates 30 respectively, of which heat generated can be absorbed by the heat conducting plates 30 and further dissipated.

The first reflector 60 mounted on the LED module 50 is a flat panel and defines a plurality of apertures 62 corresponding to the LEDs 52. The second reflector 70 consists of four lateral walls, which surround the LED module 50 and are angled with the LED module 50. The second reflector 70 defines a small open end adjacent to the LED module 50 and a large open end opposite to the small open end. An inner surface of the second reflector 70 facing the LED module 50 can reflect light generated by the LED module 50.

The cover 80 has a substantially hemispherical shape with an open end thereof engaging the base 10, thereby covering the heat sink 20 and the LED modules 50, etc. therein. The cover 80 defines three windows 82 therein corresponding to the three LED modules 50. The envelopes 85 engage the windows 82 respectively. Light generated by the LED modules 50 can project through the envelopes 85 to illuminate the surrounding environment.

The fixing member 90 comprises three chains with top ends thereof combined together. Bottom ends of the chains evenly connect to top of the chassis 11 of the base 10. The top ends of the chains connect the mounting post to fix the LED lamp at a desired position. Understandably, the fixing member 90 could be a plurality of rods or the like in alternative embodiments.

In assembly, the heat sink 20 is secured on a center of the bottom surface of the chassis 11. The heat pipes 40 are received in the grooves 34 of the heat conducting plates 30. The engaging portions 32 of the heat conducting plates 30 couple to the chassis 11 and the outer second branches 242 respectively. Specifically, the engaging portion 32 at the top end engages the bottom surface of the chassis 11 at a portion far away from the center thereof (i.e., close to a periphery of the chassis 11), and the engaging portion 32 at the bottom end engages the outer second branch 242 close to a free end thereof (i.e., close to a free end of the heat sink 20). The heat conducting plate 30 is configured such that angled with the heat conducting body 22 of the heat sink 20 and the chassis 11 of the base 10. In the present embodiment, the angle defined between the heat conducting plate 30 and the chassis 11 of the base 10 is substantially 60°. Understandably, the sharp angle could be properly varied to adjust an illumination area of the LED lamp. The engaging portions 32 have panel surfaces contacting the chassis 11 and the outer second branch 242, increasing a contacting surface therebetween. Meanwhile, the dissipating sections 42 of the heat pipes 40 contact the chassis 11 and the outer second branch 242 respectively.

The LED modules 50 are mounted under the heat absorbing portions 31 of the heat conducting plates 30 respectively. The first reflectors 60 are mounted under the heat absorbing portions 31 and on the LED modules 50. The second reflectors 70 surround the LED modules 50. The cover 80, with envelopes 85 adhered thereto, engages the chassis 11 of the base 10, covering the heat sink 20, the heat conducting plate 30, the heat pipes 40, the LED modules 50 and the first and second reflectors 60, 70 therein.

In operation, light generated by the LED modules 50 adjusted by the first and second reflectors 60, 70 project through the envelope 85. The LED modules 50 are symmetrically coupled on the periphery of the heat sink 20, increasing the illumination area of the LED lamp. The heat generated by the LED modules 50 can be absorbed by the heat conducting plates 30 and transmitted to the heat sink 20 and the base 10 for further dissipating. The heat pipes 40 can transmit the heat to the heat sink 20 and the base 10 more fast to increase a heat dissipation efficiency of the LED lamp.

It is noted that, numbers of the heat conducting branches 24 of the heat sink 20, the heat conducting plates 24, the LED modules 50 and the windows 82 of the cover 80 could be varied as desired in alternative embodiments.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light emitting diode (LED) lamp, comprising:

a base with a plurality of fins formed on a top thereof, a heat sink coupled to a bottom of the base;

a plurality of heat conducting plates coupled to a periphery of the heat sink, each heat conducting plate having one end connecting to the heat sink, and an opposite end connecting to the bottom of the base, and configured to being angled with the base and the heat sink;

a plurality of LED modules attached to the heat conducting plates respectively; and a fixing member connected to the top of the base, adapted for fixing the LED lamp on a desired position.

2. The LED lamp as claimed in claim 1, wherein the heat sink comprises a heat conducting body, a plurality of first heat conducting branches extending outwardly from a periphery of the heat conducting body and a plurality of second heat conducting branches symmetrically extending from each of the first heat conducting branches, each first heat conducting branch having a rectangular shape.

3. The LED lamp as claimed in claim 2, wherein the heat conducting plates each comprise a heat absorbing portion on which the LED modules are mounted, and two engaging portions bent from two ends of the heat absorbing portion, and wherein one of the engaging portions connects with an end of one of the second heat conducting branches far away from the base, another one of the engaging portions connects to the base.

4. The LED lamp as claimed in claim 3, further comprising at least one heat pipe embedded in each of the heat conducting plates, the at least one heat pipe comprising two heat dissipating sections respectively connecting the base and the one of the second heat conducting branches of the heat sink.

5. The LED lamp as claimed in claim 3, wherein the one of the engaging portions connects with an end of an outermost one of the second heat conducting branches.

6. The LED lamp as claimed in claim 2, wherein the heat conducting body of the heat sink is tubular in shape and the first heat conducting branches extend radially and outwardly from the periphery of the heat conducting body.

7. The LED lamp as claimed in claim 1, further comprising a cover engaging the base and covering the heat sink, the heat conducting plates and the LED modules, and a plurality of envelopes adhered to a plurality of windows defined in the cover for projection of light generated by the LED modules therethrough.

8. The LED lamp as claimed in claim 1, further comprising a plurality of panel-shaped first reflectors mounted on the LED modules respectively, and a plurality of second reflectors surrounding the LED modules respectively.

9. The LED lamp as claimed in claim 1, wherein the fixing member consists of a plurality of chains.

10. The LED lamp as claimed in claim 1, wherein the heat conducting plates are inclinedly disposed to define an acute angle between each of the heat conducting plates and the heat sink.

11. An LED lamp, comprising:

a base;

a heat sink attached to a bottom of the base and comprising a heat conducting body and a plurality of heat conducting branches symmetrically located around an outer surface of the heat conducting body;

a plurality of heat conducting plates with first ends thereof connecting with corresponding heat conducting branches and opposite second ends thereof connecting with the base; and a plurality of LED modules mounted on the heat conducting plates.

12. The LED lamp as claimed in claim 11, wherein the base is round and the heat sink is attached to a center of the bottom of the base, and wherein the first ends of the heat conducting plates connecting with the corresponding heat conducting branches are located near a free end of the heat sink, the opposite second ends of the heat conducting plates connecting with the base are located near a periphery of the base.

13. The LED lamp as claimed in claim 11, wherein the heat conducting branches comprise first branches extending from the outer surface of the heat conducting body and a plurality of second branches crossed with each of the first branches, an outermost one of the second branches connects a corresponding one of the first ends of the heat conducting plates.

14. The LED lamp as claimed in claim 11, further comprising at least one heat pipe embedded in one of the heat conducting plates and connecting with one of the corresponding heat conducting branches of the heat sink and the base.

15. The LED lamp as claimed in claim 11, further comprising a cover engaging the base and covering the heat sink, the heat conducting plates and the LED modules, and a plurality of envelopes adhered to a plurality of windows defined in the cover for projection of light generated by the LED modules therethrough.

16. The LED lamp as claimed in claim 11, further comprising a plurality of panel-shaped first reflectors mounted on the LED modules respectively, and a plurality of second reflectors surrounding the LED modules respectively.

17. The LED lamp as claimed in claim 11, further comprising a fixing member consisting of a plurality of chains and connected to a top of the base.

* * * * *